US005326321A

United States Patent [19]

Chang

[11] Patent Number: 5,326,321

[45] Date of Patent: Jul. 5, 1994

[54] ADJUSTING DEVICE FOR ADJUSTING THE INSTANTANEOUS RELATIVE ANGULAR DIFFERENCE BETWEEN TWO ROTATING MEMBERS

[76] Inventor: Ping-Lung Chang, No. 39, Lane 73 Der An First Street, Hua Lian City, Taiwan

[21] Appl. No.: 904,266

[22] Filed: Jun. 25, 1992

[51] Int. Cl.[5] ..... F01L 1/34

[52] U.S. Cl. ..... 464/2; 123/90.17

[58] Field of Search ..... 464/1, 2, 160; 123/90.17, 90.31

[56] References Cited

U.S. PATENT DOCUMENTS

| | | | |
|---|---|---|---|
| 3,714,932 | 2/1973 | Meacham et al. | 464/1 X |
| 3,934,430 | 1/1976 | Fuso | 464/2 |
| 3,978,829 | 9/1976 | Takahashi et al. | 464/2 X |
| 4,517,934 | 5/1985 | Papez | 464/2 X |
| 4,754,727 | 7/1988 | Hampton | 123/90.17 X |
| 4,967,701 | 11/1990 | Isogai et al. | 123/90.17 X |
| 5,090,366 | 2/1992 | Gondek | 123/90.17 |

FOREIGN PATENT DOCUMENTS

| | | | |
|---|---|---|---|
| 1-224407 | 9/1989 | Japan | 123/90.17 |

*Primary Examiner*—Daniel P. Stodola
*Attorney, Agent, or Firm*—Bacon & Thomas

[57] ABSTRACT

An adjusting device for adjusting the relative angular difference between two rotating members having a guide arrangement between a driving member and a rotating follower. The guide arrangement will allow the rotating driver to perform relative axial movement relative to the rotating follower to change the relative axial and angular difference between the rotating driver and the rotating follower.

5 Claims, 8 Drawing Sheets

ADJUSTING DEVICE FOR ADJUSTING THE INSTANTANEOUS RELATIVE ANGULAR DIFFERENCE BETWEEN TWO ROTATING MEMBERS

FIELD OF THE INVENTION

The present invention relates to an adjusting device which changes the relative angle between two members while rotating or stopping. It is able to be applied to an engine to control the cam shaft for the valves to facilitate a change in the ignition timing versus the cam shaft following a change in the speed of revolution so that the engine will become more efficient.

BACKGROUND OF THE INVENTION

All car manufacturers around the world are continuously seeking a totally-satisfactory car which may run smoothly at low speed driving and run powerfully at high speed driving. Although the diesel engine provides better performance at low speed, its performance at high speed is comparatively inferior. On the other hand, the gasoline engine is relatively good with regard to its performance at high speed and inferior at low speed.

Until now there has been no engine which can provide good performance consistently at different speeds—i.e., high, medium and low speed. It is chiefly because the opening time of the valves and the ignition timing fail to match up with the change in the speed of revolution of the engine.

Every car manufacturer knows that, to have an engine with good performance at high speed requires the advance of both the ignition timing and the opening of the air intake valve because the higher the speed the greater amount the ignition is advanced. Advancing the air valve at high speed allows a sufficient amount of intake air and facilitates effective exhaust of the waste gas in the cylinder. To match the advancement of ignition timing, the engine will become power driving at high speed. To attain better performance of the engine at low speed, the advancement of ignition timing has to be reduced and the opening of the air valve should not be increased so that the explosion stroke in the cylinder will be extended to increase the thrust force of the piston resulting in a large increase in torsion when driving at low speed.

As a matter of fact, the time of the opening of the intake valve and the exhaust valve, and the timing of the ignition have to be adjusted properly with the speed of revolution of the engine so as to achieve an engine with good performance at high speed, medium speed and low speed respectively. Although there are centrifugal ignition advances, and vacuum ignition advances, there is no such kind of real mechanism for the advancement of the opening of air valve.

As for the multiple-valve engine, the increase in the numbers of air valves only promotes the amount of intake and exhaust, rather than advancing the opening of both the intake and exhaust valves.

Therefore one object of the present invention is to provide an adjusting device for the relative angular difference between two rotating members, which is able to adjust the relative angular difference between the rotating driver and one or more rotating followers respectively. The present device can be mounted between the cam shaft of the air valve and the cams of various air valves as well as the cam shaft of the air valve and the driving shaft of the distributor to coordinate the adjustment of the time of the opening of the air valve and the ignition timing to allow the engine to obtain best torsion output and smoothness of driving at high speed, medium speed and low speed.

SUMMARY OF THE INVENTION

The adjusting device of the relative angular difference between two rotating members according to the present invention provides at least one guide arrangement for the driving member, and a driven guide arrangement for at least one rotating follower. The driven guide arrangement(s) will slide under the guidance of the rotating driver to perform relative axial movement against the rotating driver and/or the rotating followers to change the relative axial angular difference between the rotating driver and the rotating followers.

The present invention comprises also an adjusting circuit which includes a measuring device for measuring revolution speed, a memory unit for the revolution speed/angular difference, a measuring device for the angular difference, a comparator and an electromagnet. The memory unit for the revolution speed/angular difference is used for the storage of a preset revolution speed and the corresponding angular difference, and the measuring device for the revolution speed is used for measuring the instantaneous revolution speed of rotating drivers. To retrieve the preset and stored angular difference under the instantaneous speed of revolution from the measuring device for revolution speed and the comparator is utilized to compare the preset and stored angular difference and the real angular difference will be measured by the measuring device for angular difference. The result of the comparison will be the basis for the changes in the magnetic force of the electromagnet so as to adjust the above real angular difference to cause the real angular difference and the preset and stored angular difference to be the same.

DETAILED DESCRIPTION OF THE PREFERRED EMBODIMENTS

Figure 1:
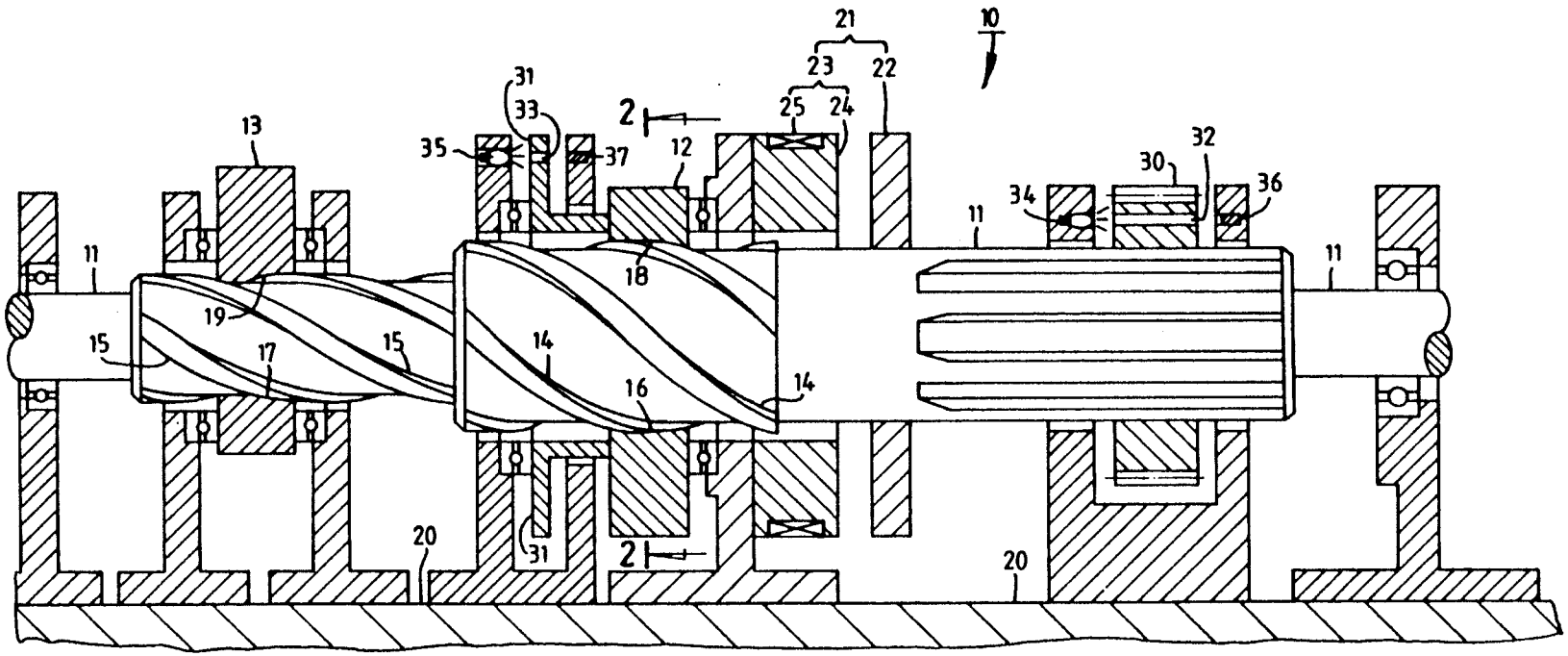
FIG. 1 is a cross-sectional elevation view showing the first embodiment of the present invention.
Figure 2:
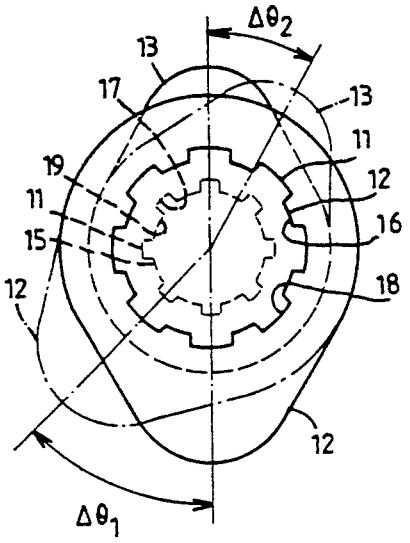
FIG. 2 is a cross-sectional elevation view taken along line 2—2 of FIG. 1.

Referring to FIGS. 1 and 2, an adjusting device 10 for adjusting the instantaneous relative angular difference between two rotating members, comprises a rotating driver 11 and two (or more) rotating followers 12 and 13. There are at least two guide arrangements 14, 15 for the rotating driver 11; the two guide arrangements 14, 15 shown in the embodiment provide an external thread with different (or same) thread angle. For the convenience of mounting, the above thread is mounted at the outer edge of the step cylinder at different diameters. The above two rotating followers 12, 13 provide inner holes 16, 17 and there are two guided arrangements 8, 9 in the inner holes 16, 17 respectively. The two guided arrangements 8, 9 shown in the embodiment are internal threads (or other curved rail), and the thread angle is the same as that of above external thread (or other curve rail) so as to be coupled mutually. While the rotating driver 11 is in rotation, as the respective axial position of the two rotating followers 12, 13 relative to a base 20 always remain unchanged, the rotating driver 11 and the two rotating followers 12, 13 are in rotation synchronously all the time. If the relative angular differences between the rotating driver 11 and the two rotating followers 12, 13 are set to 0 respectively, once the rotating driver 11 is moved axially, the two rotating followers 12, 13 will be forced to turn at $0_1$ and $0_2$ relative to the driving member 11 respectively by the guide arrangements 14, 15 of the threads (referring to FIG. 2).

There are many ways to control axial movement of the driving member 11, for instance, to utilize hydraulic driving, electromagnetic driving, step motor driving (including linear step motor and rotary step motor), etc. Electromagnetic driving structure 21 shown in the embodiment includes permanent magnet 22 and electromagnet 23 in which the permanent magnet is fixed on the rotating driver 11, and the electromagnet 23 is fixed on the base 20 (for example, the body of engine may be used as the base 20). The electromagnet 23 includes an iron core and the permanent magnet 22 are reversed, they will be mutually repulsed to push the rotating driver 11 forward; on the other hand the rotating driver 11 will be pulled backward.

The means of measuring the relative angular difference between the rotating driver 11 and the rotating followers 12, 13 (or phase difference) will be described in detail below:

Reference number 30 is a rotating disc or gear coaxially in rotation with the rotating the rotating driver 11; reference number 31 is a rotating disc or the rotating follower itself coaxially in rotation with the rotating follower 12 or 13; circular holes in same number (one or two is/are adequate) 32, 33 are provided at the edge of the two rotating discs, and each set of lights and detectors 34, 35 and 36, 37 are provided at the two sides of the circular holes 32, 33, in which 34 and 35 are the sources of the light and 36, 37 are light receiving transistors.

Figure 5:
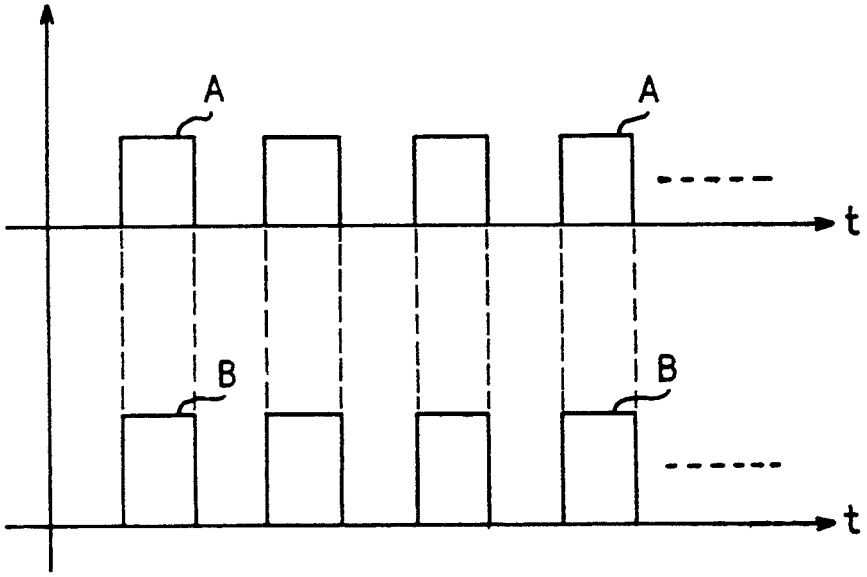
FIG. 5 is a diagram showing the pulse generated by the control circuit of FIG. 7 of the present invention.
Figure 6:
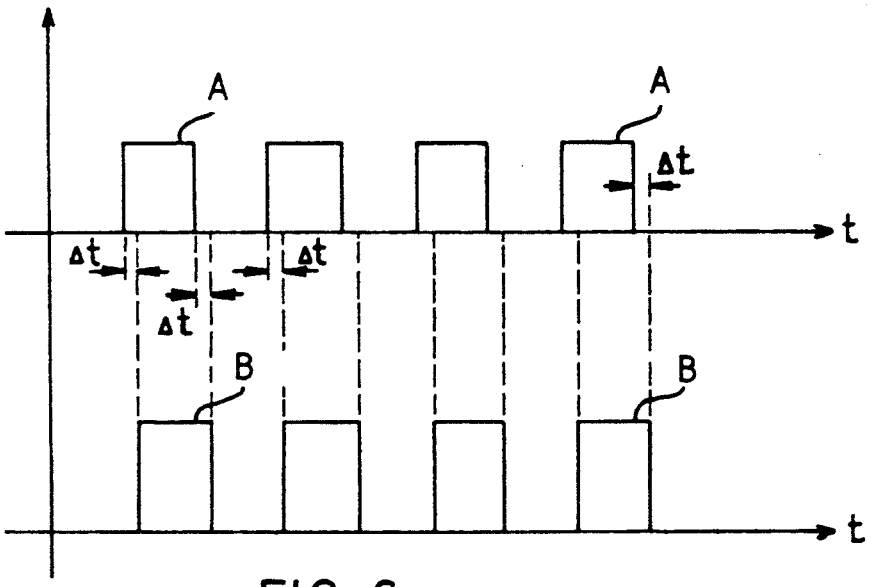
FIG. 6 is a diagram showing the pulse generated by the control circuit of FIG. 7 of the present invention.

Referring to FIGS. 5 and 6, the pulse is to be produced by the intermittent blocking of the light sources 34,35 to the light receiving transistors 36, 37 while the rotating discs 30, 31 are in rotation.

If the angular difference between the rotating discs 30, 31 is set to 0 initially, the phase difference of the pulse is produced by the light receiving transistors 36, 37 will be 0, the phase difference of the pulse to be provided by the light receiving transistors 36, 37 will be 0. Referring to FIG. 5, A and B are the pulses to be provided by the light transistors 36, 37 respectively, and the phase difference shown in 0.

As matter of fact, the angular difference between the rotating discs 30, 31 is exactly the angular difference between the rotating driver 11 and the rotating follower 12. Accordingly, to compute the phase difference by using current electronic technology, it will be converted into the angular difference between the rotating driver 11 and the rotating follower 12. In addition, the calculation of the frequency of A or B, can be converted into the instantaneous speed of revolution of the rotating driver 11.

Figure 7:
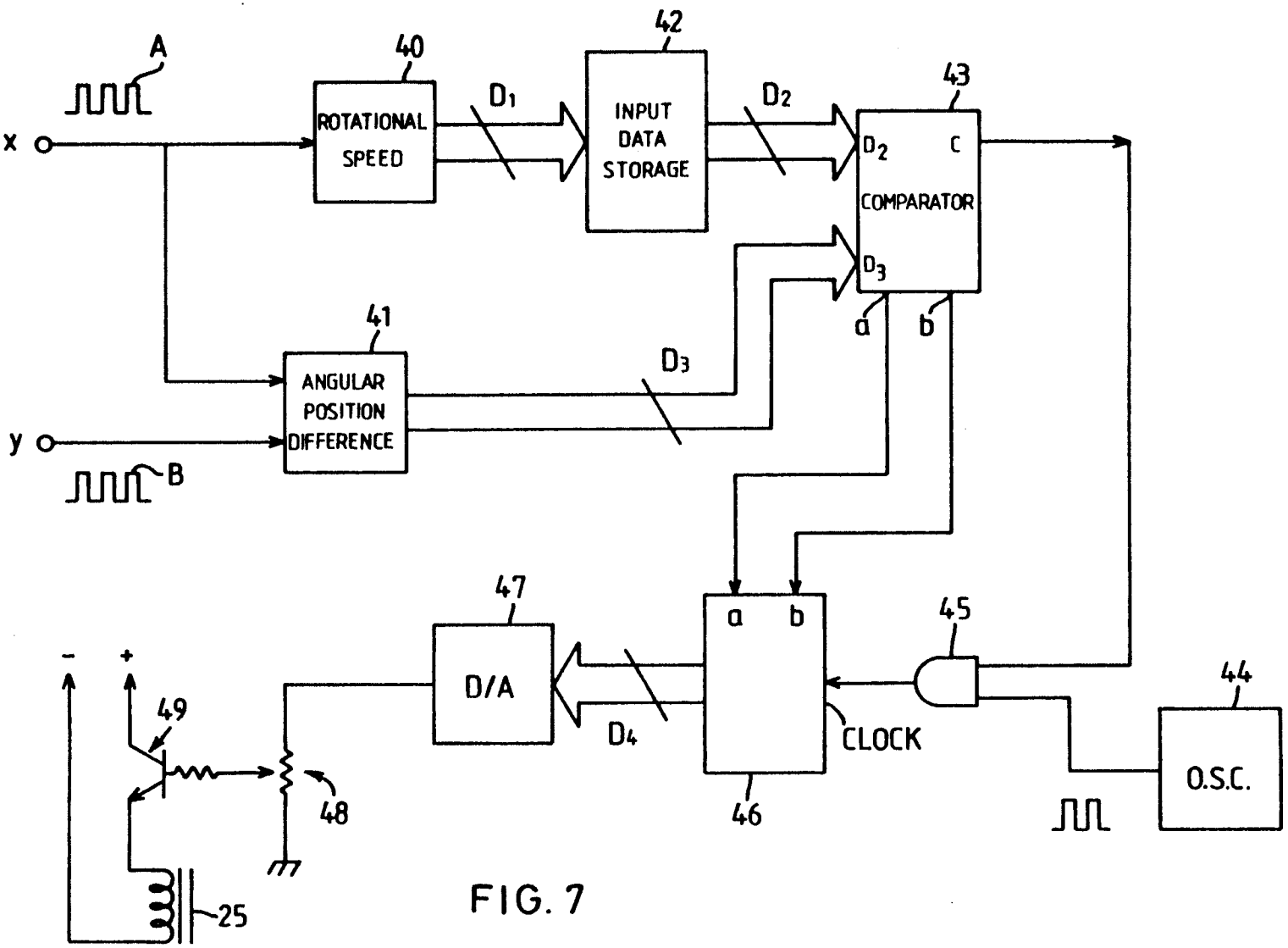
FIG. 7 is a block diagram showing the control circuit of the present invention.

FIG. 7 is a block diagram showing the electronic circuit of the present invention and further details are discussed below:

The block circuit 40 is a measuring device for the revolution speed, it is determined by the calculation of the frequency of A, and the result measured is output through $D_1$.

The circuit block 41 is a measuring device for the angular difference, it is determined by the calculation of the phase difference between A and B, and the result measured is output through $D_3$.

Circuit block 41 is a memory unit for the revolution speed in which initially stored data relates to the value of angular difference corresponding to each revolution speed; these data are the best angular difference to be tested initially. Each revolution speed is considered to be an address of memory, and what is stored in each address is the angular difference of that revolution speed. While $D_1$ offers a revolution speed, the memory unit will read out the corresponding angular difference and output through $D_2$.

The data on $D_2$ is the current angular difference between the rotating drier 11 and the rotating follower 12, and $D_2$ is the best angular difference to be tested and stored initially. To compare $D_2$ and $D_3$, the function of the comparator 43 is shown below:

(1) If $D_2=D_3$, then $c=0$, $a=0$, $b=0$ (2) If $D_2>D_3$, then $c=1$, $a=1$, $b=0$ (3) If $D_2<D_3$, then $c=0$, $a=0$, $b=1$ The oscillator 44 is used for the generation of the counting pulse; AND gate 45 and the counter 46 allows counting upward and downward. When $a=1$, $b=0$, it will count upward; when $a=0$, $b=0$, it will count downward; when $a=0$, $b=0$, the counter remains disabled.

If $D_2=D_3$, where $a=0$, $b=0$, the counter 46 remains disabled; and owing to $c=0$, the pulse to be provided by the oscillator 44 is unable to enter into the clock end of the counter 46.

If $D_2>D_3$, where $a=1$, $b=0$, the counter counts upward, owing to $c=1$, the pulse to be generated in the oscillator will enter into the counter 46 by virtu of AND gate 45 to count upward. It will cause the data in $D_4$ to increase gradually. A D/A converter 47, when $D_4$ is increasing the output voltage from the D/a converter 47 is increasing accordingly while the resistance of the transistor 49 is decreasing whereby the voltage acquired by the coil 25 is increasing gradually. The circuit also includes a variable resistor 48 and a high-current resistable transistor 49. The above description shows that gradual increase of $D_4$ will cause gradual increase of the voltage at coil 25. If the direction of the magnetic flux of the electromagnet 25 is designed to be always contrary to the magnetic flux of the permanent magnet 25, the higher the voltage of the two ends of electromagnet 25, the greater the force to thrust the permanent magnet 22; and the angular difference between the rotating driver 11 and the rotating follower 12 becomes greater. The angular difference will enter into 43 from $D_3$ to compare with $D_2$ until the result of comparing is equal, then a and be will be equal to 0. The counter 46 remains disabled at that moment. While $D_4$ becomes stable, the voltage of 25 also becomes stable. Under such circumstances the angular difference between the rotating driver 11 and the rotating follower 12 will be adjusted to the best value as tested initially.

Owing to the same reason, if $D_2 < D_3$, then the counter 46 will count downward to cause the voltage on the two ends of 25 to decrease gradually until $D_2 = D_3$. The principle of this part will not be described in detail.

As the phase difference between another rotating follower 13 and the rotating follower 12 has already been decided by the relative relationship between the spiral groove type guide arrangements 14 and 15 of the two members, and the relative relationship has already been determined in manufacturing, the phase difference between another rotating follower 13 and the rotating driver 11 can be converted without the necessity of mounting additional rotating discs 30, 31 and the light detector.

Figure 3:
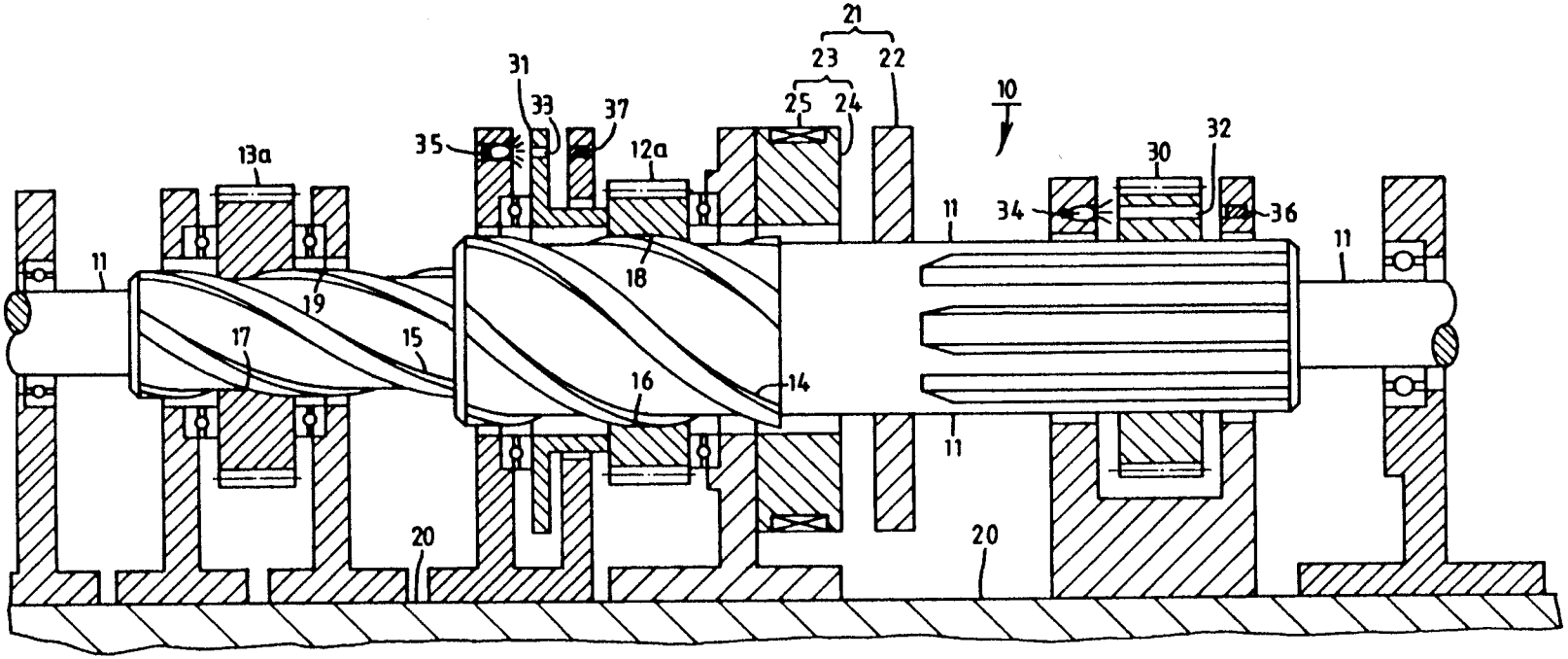
FIG. 3 is a cross-sectional elevation showing the second embodiment of the present invention.

The rotating followers 12, 13 . . . may be designed as air valve cam respectively (as shown on FIGS. 2, 3), and guide arrangements 14, 15, etc., are provided in the holes of an axle. The rotating driver 11 of the present invention is used to replace the original cam axle of the air valve. Referring to FIG. 3, the rotating followers 12, 13 may also be designed as gears 12*a*, 13*a* respectively to coordinate with other gears to drive the original air valve cam axle, in which case the gear 12*a* is used to drive the turning angle of the distributor, and another gear 13*a* is used to drive the air valve cam axle.

The guide arrangements 14, 15 and the driven guide arrangements 18, 19 may also be replaced with the ball driving screws or designed into special curve guides subject to actual requirement. In addition, the rotating driver 11 may be driven in rotation rather than axial movement, while the rotating followers 12, 13 may be driven in axial movement respectively or synchronously to change the angular difference between with the rotating driver 11 respectively.

Figure 4:
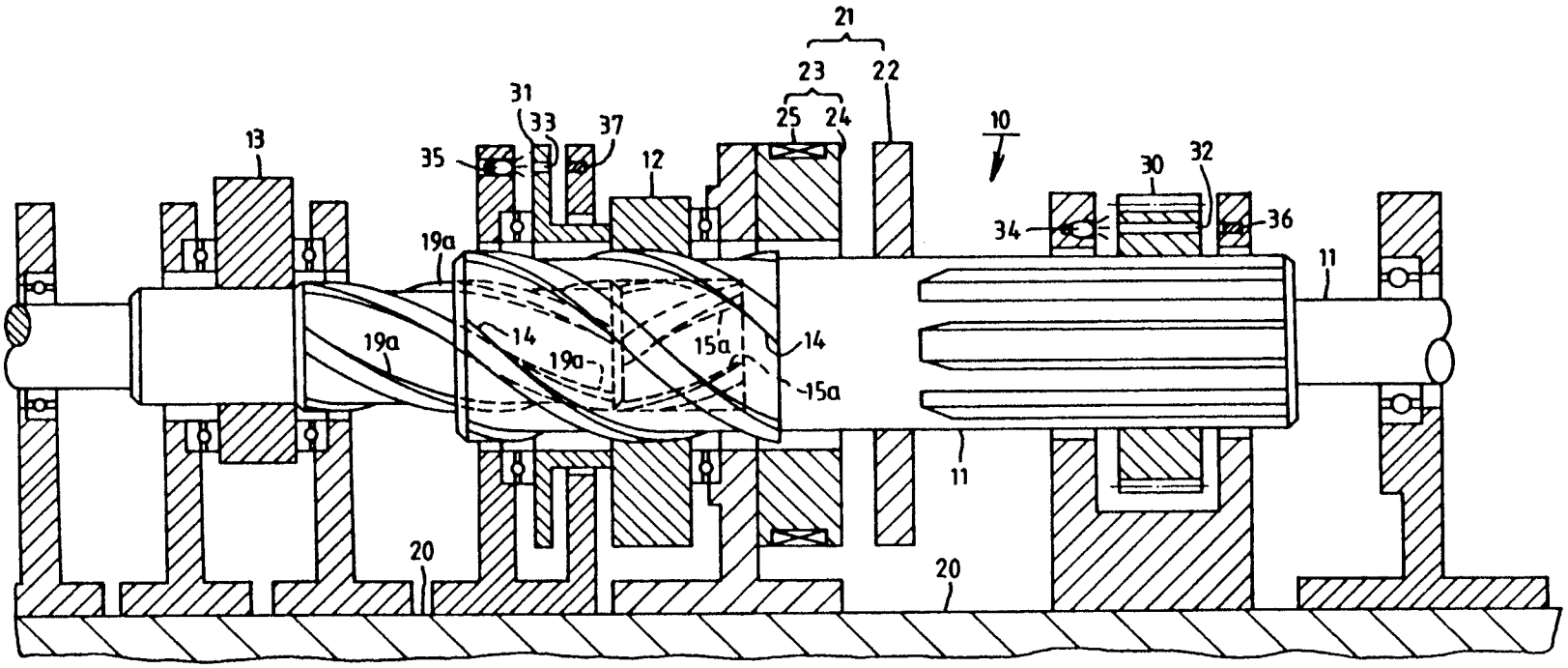
FIG. 4 is a cross-sectional elevation view showing the third embodiment of the present invention.

Referring to FIG. 4, the guide arrangement may be replaced with internal thread 15*a* while the corresponding driven guide arrangement of the rotating follower 13 will be replaced with external thread 19*a*.

The present invention is also applicable to a Noslip differential or variable speed gear.

Figure 8:
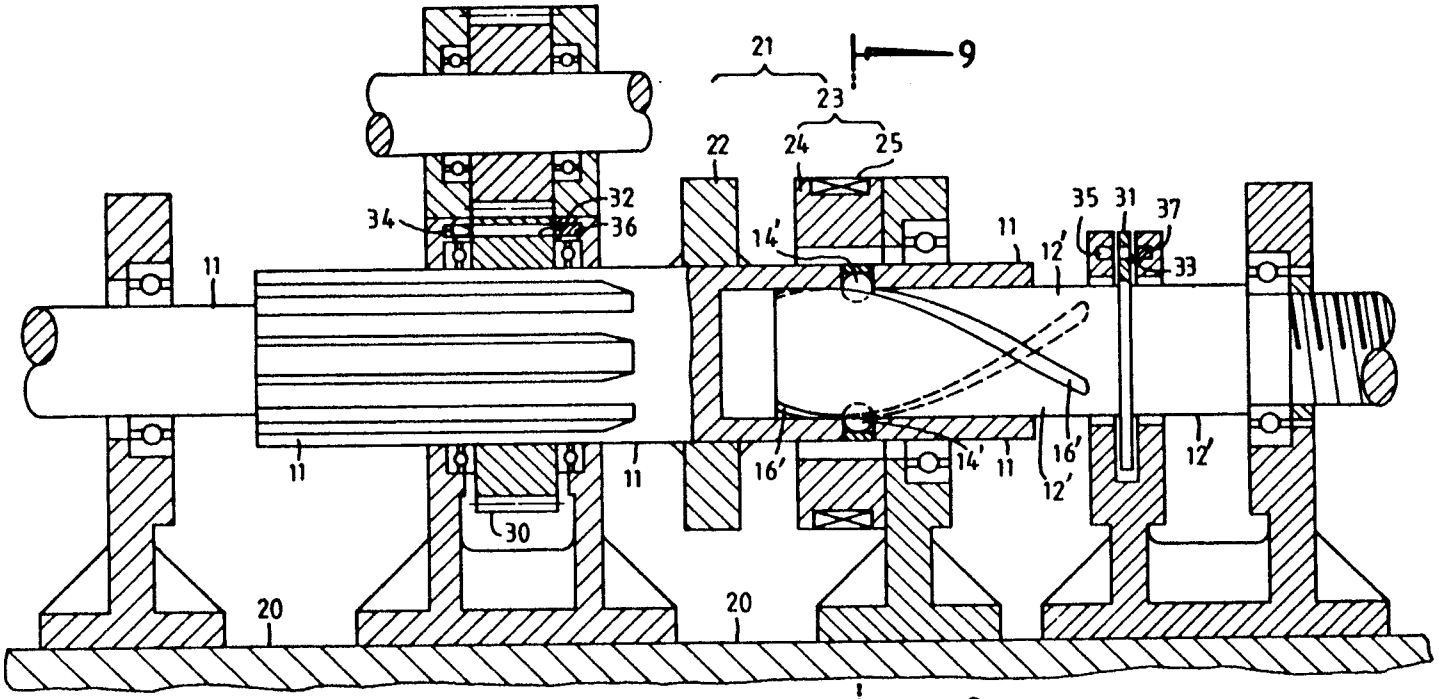
FIG. 8 is a cross-sectional elevation view showing the fourth embodiment of the present invention.
Figure 9:
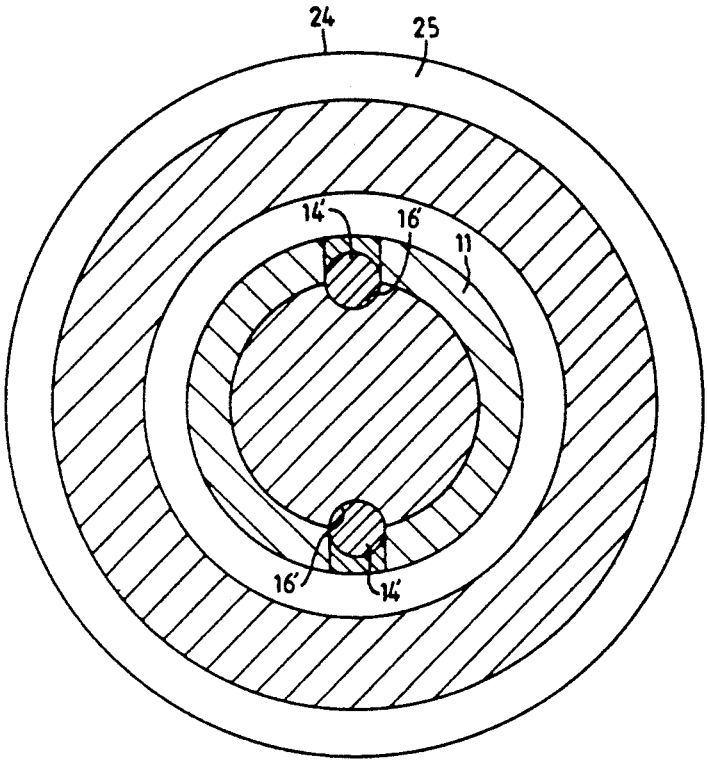
FIG. 9 is a cross-sectional elevation view taken along line 9—9 of FIG. 8.

Referring to FIG. 8, the embodiment comprises a single rotating member 12' to be driven by the rotating driver 11, the guide arrangement 14' of the rotating driver 11 are steel balls, and the guide arrangements 16' of the rotating follower 12' are spiral grooves. The relative axial positioned of the rotating driver 11 and the rotating follower 12' can be changed through the radial guide action between the guide arrangement 14' and the driven guide arrangement 16'.

1. The present invention employs the same driving rotating member 11 to drive two or more rotating followers 12, 13 in relative rotation in same or different manner respectively so as to change the angular difference (phase difference) between with the rotating followers 12, 13 respectively; to coordinate with the use of the measuring device 40 for the revolution speed and the measuring device 41 for angular difference, it can control the respective angular difference accurately (the electronic circuit for the control of the angular difference is not included in the characteristics of the present invention). Therefore, it is quite suitable to the control of the ignition advancement and advancing the opening of air valve for an engine, and the respective amount of advancement may be determined by making guides with different guide strokes. Such data can be stored in the memory unit 42 for initial revolution speed/angle (the data of advancement are obtained from the tests of various engines and it is not included in the characteristics of the present invention). The simple and convenient structure of the present invention can control the air valve and the ignition system of the engine in an accurate manner so that it may accomplish appropriate advancements at difference revolution speeds subject to the requirement by the designer, and the engine can allow to develop its full efficiency at high, medium and low speed.

2. The present invention is also applicable to a Noslip differential of car.

3. The present invention is also applicable to other mechanisms, such as a variable speed gear.

What is claimed is:

1. A device for adjusting the relative angular difference between rotating members comprising:

a) a rotatable driver member having an axis of rotation;

b) a rotatable follower member;

c) a guide arrangement interconnecting the rotatable driver member and the rotatable follower member such that the follower member rotates with the driver member whereby relative axial movement between the driver member and the follower member along the axis of rotation changes the angular position of the follower member with respect to the driver member;

d) axial movement means operatively associated with the driver member to axially move the driver member along its axis of rotation relative to the follower member, wherein the axial movement means comprises:

i) a permanent magnet attached to the driver member so as to rotate therewith and ii) a stationary electromagnet including a core and a coil, and located adjacent to the permanent magnet such that attraction or repulsion of the permanent magnet toward or away from the electromagnet causes axial movement of the driver member; and, e) control means operatively associated with the axial movement means, the control means comprising:

i) speed measuring means to measure the instantaneous rotational speed of the driver member;

ii) means to measure the instantaneous angular difference between the driver member and the follower member;

iii) data input means to store data relating to a desired angular difference between the driver member and the follower member at a particular rotational speed of the driver member; and, iv) comparator means operatively associated with the speed measuring means, the means to measure the instantaneous angular difference, the data input means and the axial movement means to compare the measured angular difference with the desired angular difference at the speed of rotation of the driver member and to emit a control signal to the axial movement means to adjust the relative axial positions of the driver member and follower member such that the measured angular difference corresponds to the desired angular difference.

2. The device of claim 1 wherein the guide arrangement comprises:

a) an external threaded portion formed on the driver member; and, b) an internal threaded portion formed on the follower member engaged with the external threaded portion of the driver member.

3. The device of claim 2 further comprising:

a) a second follower member;

b) a second external threaded portion formed on the driver member;

c) a second internal threaded portion operatively connected to the second follower member and engaging the second external threaded portion.

4. The device of claim 1 wherein the guide arrangement comprises:

a) a helical slot defined by the follower member; and, b) a ball member associated with the driver member and engaging the helical slot.

5. The device of claim 1 wherein the means to measure the instantaneous angular difference between the driver member and the follower member comprises:

a) a first electrical pulse generator operatively associated with the driver member; and, b) a second electrical pulse generator operatively associated with the follower member; and, c) means operatively associated with the first and second pulse generators to determine the phase difference between the pulses generated by the first and second pulse generators.

* * * * *